US010062945B2

(12) United States Patent
Brueggemann et al.

(10) Patent No.: US 10,062,945 B2
(45) Date of Patent: Aug. 28, 2018

(54) COUPLING STRUCTURE FOR CROSSING TRANSMISSION LINES

(71) Applicants: Oliver Brueggemann, Oelbronn-Duerrn (DE); Matthias Steinhauer, Steinheim (DE); Juan Pontes, Stuttgart (DE)

(72) Inventors: Oliver Brueggemann, Oelbronn-Duerrn (DE); Matthias Steinhauer, Steinheim (DE); Juan Pontes, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 264 days.

(21) Appl. No.: 14/378,292

(22) PCT Filed: Dec. 17, 2012

(86) PCT No.: PCT/EP2012/075711
§ 371 (c)(1),
(2) Date: Aug. 12, 2014

(87) PCT Pub. No.: WO2013/120561
PCT Pub. Date: Aug. 22, 2013

(65) Prior Publication Data

US 2015/0035616 A1 Feb. 5, 2015

(30) Foreign Application Priority Data

Feb. 13, 2012 (DE) ..... 10 2012 202 097

(51) Int. Cl.
*H01P 5/12* (2006.01)
*H01P 5/22* (2006.01)
*H01P 5/02* (2006.01)

(52) U.S. Cl.
CPC ..... *H01P 5/12* (2013.01); *H01P 5/02* (2013.01); *H01P 5/227* (2013.01)

(58) Field of Classification Search
CPC .... H01P 5/18; H01P 5/184; H01P 5/19; H01P 5/227
(Continued)

(56) References Cited

U.S. PATENT DOCUMENTS 3,621,400 A * 11/1971 Paciorek ..... H03H 7/48 330/53
3,678,415 A * 7/1972 Kuroda ..... H01P 5/227 333/114
(Continued)

FOREIGN PATENT DOCUMENTS

EP 0313058 4/1989
JP 61172407 8/1986
(Continued)

OTHER PUBLICATIONS

Isao Ohta et al., A Transmission-Line-Type Eight-Port Hybrid, 1992, IEEE MTT-S, 4 pages.*
(Continued)

*Primary Examiner* — Dean Takaoka
(74) *Attorney, Agent, or Firm* — Norton Rose Fulbright US LLP; Gerard Messina

(57) ABSTRACT

A coupling structure for crossing three transmission lines millimeter-wave or centimeter-wave signals a signal conductor layer of a circuit substrate, the coupling structure comprising three planar cross-couplers, and from each of the three cross-couplers two input/output points of the cross-coupler being connected clockwise in succession in the plane of the cross-coupler, to respectively one input/output point of a respective other of the three cross-couplers.

6 Claims, 3 Drawing Sheets

(58) Field of Classification Search
USPC ..... 333/116, 117, 125, 128
See application file for complete search history.

(56) References Cited

U.S. PATENT DOCUMENTS

| | | | | | |
|---|---|---|---|---|---|
| 3,772,616 | A * | 11/1973 | Imoto | H01P 5/227 | 333/116 |
| 4,127,831 | A | 11/1978 | Riblet | | |
| 4,679,010 | A | 7/1987 | Bahl | | |
| 5,883,552 | A * | 3/1999 | McKay | H01P 5/16 | 333/125 |
| 6,522,218 | B1 * | 2/2003 | McKay | H01P 5/12 | 333/117 |
| 2009/0108954 | A1 | 4/2009 | Cheung et al. | | |

FOREIGN PATENT DOCUMENTS

| | | | |
|---|---|---|---|
| JP | S63-294103 | A | 11/1988 |
| JP | 0738301 | A | 2/1995 |
| JP | 2011041137 | | 2/2011 |
| JP | 5243821 | B2 | 7/2013 |

OTHER PUBLICATIONS

Tadashi Kawai et al., A Branch-Line-Type Eight Port Comparator Circuit, 1991, IEEE MTT-S, 4 pages.*

"Microstrip EHF Butler Matrix Design and Realization", *ETRI Journal,* vol. 27, No. 6, Dec. 2005, J.-S. Néron and G.-Y. Delisle.

Bing, Zhao, et al. "The design of the X-band microstrip butler matrix", School of electronic engineering, China, CN Academic Journal Electronic Publishin House (2009), pp. 983-986. [English abstract only].

* cited by examiner

COUPLING STRUCTURE FOR CROSSING TRANSMISSION LINES

FIELD OF THE INVENTION

The present invention relates to a coupling structure for crossing transmission lines in a signal conductor layer of a circuit substrate, in particular, to a coupling structure for crossing transmission lines for millimeter-wave or centimeter-wave signals.

BACKGROUND INFORMATION

To cross transmission lines for high frequency signals it is known to provide a circuit substrate having multiple metallization layers, on which transmission lines, developed in different metallization layers, can cross each other. For this purpose, a transmission line in a metallization layer can bridge a crossing area by a detour via a different metallization layer. A disadvantage in this instance is the additional effort for providing a second or more metallization layers.

It is also known to realize a crossing of two transmission lines of the same metallization layer via a bridge made up of a discrete component. Depending on the requirements, however, disadvantageous output losses can result.

In "Microstrip EHF Butler Matrix Design and Realization", *ETRI Journal*, Volume 27, No. 6, December 2005, J.-S. Néron and G.-Y. Delisle describe a coupling structure for crossing two transmission lines for a 36 GHz signal. The coupling structure is made up of a planar cross-coupler, also known as a 0-dB coupler, that enables crossing two transmission lines having minimal coupling between them. The planar cross-coupler is embodied as a cascade of two 90 degree hybrid couplers. From an input signal at one of two input points, such a 90 degree hybrid coupler, known per se, generates two signals phase-shifted by 90 degrees, at its output points.

SUMMARY

An object of the present invention is to create a coupling structure for crossing three transmission lines, in particular for signals in the frequency band of 76 to 77 GHz, in one signal conductor layer of a circuit substrate.

According to the present invention, a contribution toward achieving this object is made by a coupling structure for crossing three transmission lines for millimeter-wave or centimeter-wave signals in a signal conductor layer of a circuit substrate, which coupling structure has three planar cross-couplers, from each of which two successive input/output points of the cross-coupler are connected clockwise, in the plane of the cross-coupler, to respectively one input/output point of a respective other of the three cross-couplers. Preferably, the signal conductor layer is a metallization layer of the circuit substrate.

This coupling structure in particular allows for the mentioned clockwise-successive input/output points of each cross-coupler are connected to respectively one input/output point of a respective other of the three cross-couplers in the same signal conductor layer. A coupling structure for crossing three transmission lines may thus be realized within a single signal conductor layer, in which the coupling structure has no components situated outside of the signal conductor layer, in particular, no discrete components.

This kind of coupling structure may, for example, be used advantageously in analog and/or digital circuits for radar sensors where signals of a respective frequency range are to cross within one metallization layer.

DETAILED DESCRIPTION

Figure 1:
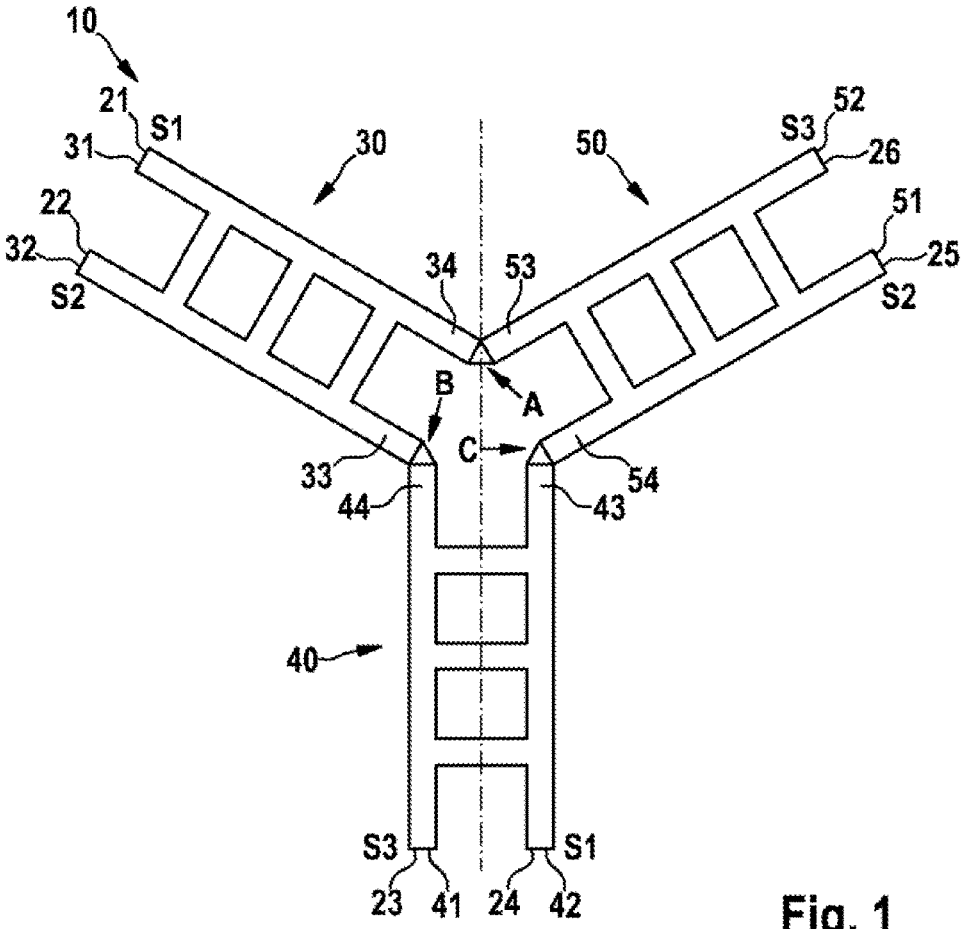
FIG. 1 shows a schematic diagram of a coupling structure according to the present invention.
Figure 2:
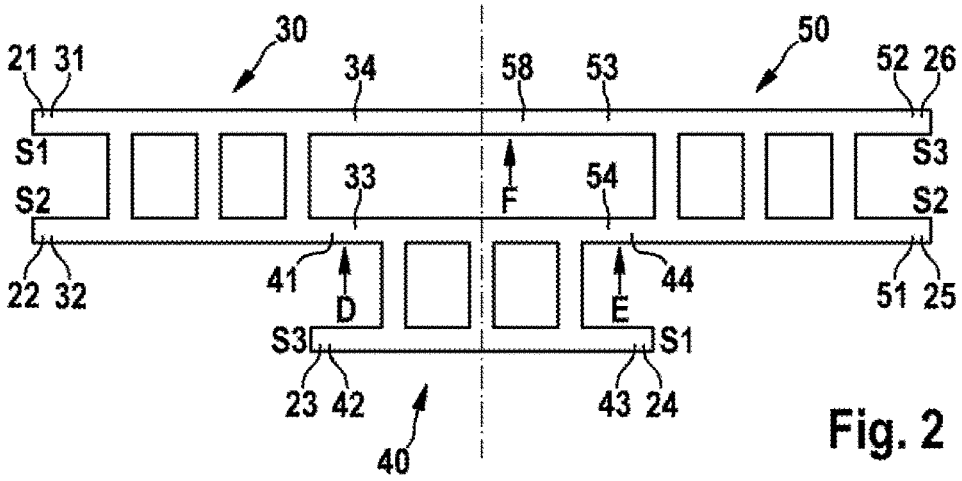
FIG. 2 shows a schematic diagram of a further example of a coupling structure according to the present invention.
Figure 4:
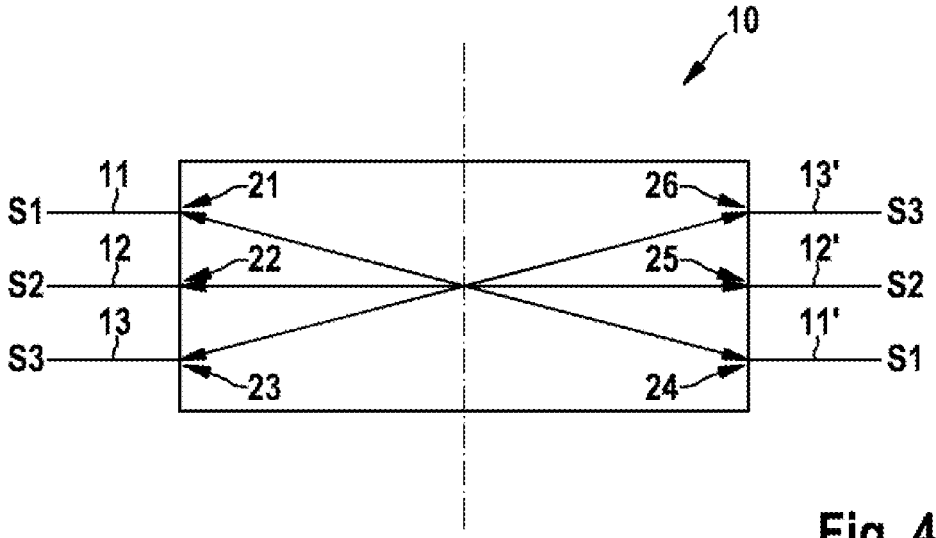
FIG. 4 shows a schematic diagram of three transmission lines crossed by a coupling structure according to the present invention.

FIGS. 1 and 2 show different examples of coupling structures 10, 10' for crossing three transmission lines 11, 12, 13 for signals S1, S2 and S3 in the frequency band of 76 to 77 GHz according to the schematic representation in FIG. 4. From a first circuit side, to the left in FIGS. 1, 2, and 4, signal lines 11, 12, 13 (FIG. 4), adjacently disposed in this order, are each connected with one input/output point 21, 22, 23, for the three signals S1, S2, S3. On the opposite side of coupling structure 10, and in reversed order, continuations of the three signal lines 13', 12', 11' for signals S3, S2, S1 are each connected to an input/output point 26, 25, 24 of coupling structure 10. The signals applied at input/output points 21, 22, 23 of the one side of the coupling structure are transmitted to input/output points 26, 25, 24 of the other side of coupling structure 10 in such a way that the order of the signals (i.e., the order in which the signal paths are juxtaposed) is reversed. In FIGS. 1, 2, and 4, the respective sides of coupling structure 10 or 10' are separated by a dashed line.

FIG. 1 shows a first example of a coupling structure 10 according to FIG. 4. Coupling structure 10 is made up of three planar cross-couplers 30, 40, 50 that are connected to one another in a star configuration and that are situated in the same signal conductor layer of a circuit substrate. Two adjacent first input/output points 31, 32 of a first cross-coupler 30 form input/output points 21, 22 of the coupling structure; two adjacent first input/output points 41, 42 of a second cross-coupler 40 form input/output points 23, 24 of the coupling structure; and two adjacent first input/output points 51, 52 of a third cross-coupler 50 form input/output points 25, 26 of coupling structure 10.

Opposite the respective cross-couplers 30, 40, 50, adjacent second input/output points 33, 34 of the first cross-coupler are each directly connected in the same signal conductor layer, at circuit points B, A, with a second input/output point 44 or 53 of a respective other cross-coupler 40, 50 of the three cross-couplers; and an additional second input/output point 43 of the second cross-coupler is directly connected in the same signal conductor layer, at a circuit point C, with an additional second input/output point 54 of the third cross-coupler 50.

Thus, respectively two adjacent first input/output points 31,32; 41,42; and 51,52 of a respective cross-coupler 30, 40, 50 form input/output points 21 through 26 of the coupling structure; and on an opposite side of the respective cross-coupler 30, 40, 50, adjacent second input/output points 33,34; 43,44; and 53,54 of the cross-coupler are respectively connected, directly in the same signal conductor layer, to a second input/output point 44,53; 54,33; and 34,43 of a respective other of the three cross-couplers 30, 40, 50.

The resulting coupling structure 10 couples signals S1, S2, S3, supplied in this order on the first side via input/output points 21, 22, 23, with input/output points 26, 25, 24 in reversed order on the opposite side of coupling structure 10. A suitable layout of the individual parts or conductor sections of coupling structure 10 and of the individual parts or conductor sections of cross-couplers 30, 40, 50 may optimize the geometry of coupling structure 10 and of individual cross-couplers 30, 40, 50 in such a way that the components of the respectively desired signal S3, S2, or S1 are constructively superimposed on one another at input/output points 26, 25, 24, used as outputs, and that the components of the respective other signals are destructively superimposed. Especially the electrical lengths and transmission line wave impedances are suitably adjusted. This may be achieved by adapting the conductor lengths and widths for a given substrate. In this manner, a minimal mutual interference of the signals may be achieved when crossing the three signal transmission lines 11, 12, 13.

FIG. 2 shows a second example of a coupling structure 10' according to the present invention that also includes three planar cross-couplers 30, 40, 50. The cross-couplers are arranged in series, a first cross-coupler 30, on the first side of coupling structure 10', coupling two first input/output points 31, 32 of cross-coupler 30 for signals S1, S2, corresponding to input/output points 21, 22 of coupling structure 10', with second input/output points 33, 34, disposed in reversed order, of cross-coupler 30. A second input/output point 33 of the first cross-coupler 30 is directly connected, at a circuit point D, to a first input/output point 41 of a second, subsequent cross-coupler 40, whose other first input/output point 42 is assigned to signal S3 and corresponds to input/output point 23 of coupling structure 10'. Second cross-coupler 40 is connected to the second input/output point 33 of first cross-coupler 30 that is situated diagonally opposite of the first input/output point 31 for signal S1. Accordingly, on the described side of coupling structure 10', signals S1, S2, S3 are conveyed next to one another in this order.

Via second cross-coupler 40, circuit point D is coupled with a diagonally opposite, second input/output point 43 of second cross-coupler 40 for signal S1, corresponding to input/output point 24 of coupling structure 10'. Accordingly, via second cross-coupler 40, signal S3, applied at the other first input/output point 42 of second cross-coupler 40, is directly connected in the same signal conductor layer, at diagonally opposite circuit point E, to a second input/output point 54 of the third cross-coupler 50.

The other second input/output point 53 of third cross-coupler 50 is connected, at a circuit point F, directly in the same signal conductor layer, by signal line 58 in the form of a conductor section, to the other second input/output point 34 of first cross-coupler 30. This connection thus runs parallel to the second cross-coupler 40. Via third cross-coupler 50, the two circuit points E, F are in turn coupled with respectively diagonally opposite first input/output points 52, 51 of third cross-coupler 50, which correspond to input/output points 26, 25 of coupling structure 10', so that coupling structure 10' altogether reverses the order in which signals S1, S2, S3 are arranged.

Figure 3:
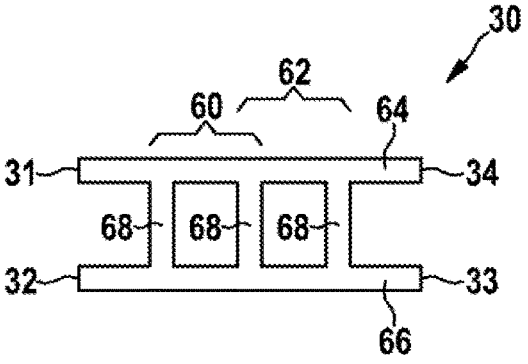
FIG. 3 shows a schematic diagram of a cross-coupler in the form of a 90 degree hybrid coupler.

With reference to cross-coupler 30, FIG. 3 schematically shows the structure of one of the cross-couplers 30, 40, 50 in FIG. 1 or 2. The remaining cross-couplers 40, 50 are structured accordingly.

Cross-coupler 30 is designed as a cascade of two 90 degree hybrid couplers 60, 62; at a first end of the cascading structure, first input/output points 31, 32 of the cross-couplers being situated directly next to each other, and at a second end of the cascading structure, second input/output points 34, 33 being situated directly next to each other. In the plane of cross-coupler 30, the input/output points follow in sequence clockwise in the order of 31, 34, 33, 32, 31, . . . etc. Cross-coupler 30 includes two longitudinal connections 64, 66, which connect input/output points 31 and 34 and, respectively, 32 and 33 directly and in a straight line, and are connected to each other by three cross-connections 68 so as to form a structure in the shape of a ladder having three crossbars. The length of cross-connections 68 amounts to nearly one quarter of a signal wavelength in the signal transmission line. The length of the respective sections of the longitudinal connections 64, 66 between two cross-connections 68 also corresponds to nearly one quarter of a signal wavelength.

In the examples shown in FIGS. 1 and 2 at least two cross-couplers 30, 50 of the three cross-couplers each have at one end of the respective cascade of their 90 degree hybrid couplers 60, 62, two adjacent input/output points 31, 32 and 51, 52, respectively, which form input/output points 21, 22 and, respectively, 25, 26 of coupling structure 10, 10'. In the example shown in FIG. 1, this applies to each of the three cross-couplers.

Figure 5:
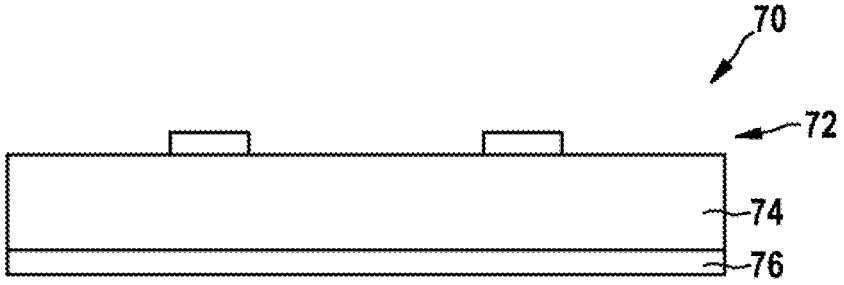
FIG. 5 shows a schematic diagram of a layering structure of a circuit substrate.

FIG. 5 shows schematically a structure of circuit substrate 70, on which, for example, coupling structure 10 or 10' is realized. Circuit substrate 70 includes a signal conductor layer 72 in the form of an accordingly structured metallization layer, in which the respective coupling structure 10, 10' is developed. Circuit substrate 70 further includes a support plate 74 in the form of a dielectric medium and a ground layer 76. Signal conductor layer 72 and ground layer 76 are situated on opposite sides of support plate 74.

What is claimed is:

1. A coupling structure for crossing three transmission lines for one of millimeter-wave signals and centimeter-wave signals in a signal conductor layer of a circuit substrate, comprising:

three planar cross-couplers that each includes two input/output points, wherein, for each of the three planar cross-couplers, each of the input/output points of the respective cross-coupler is connected, at a connection point, to a respective input/output point of another one of the three planar cross-couplers that is adjacent to the respective cross-coupler, thereby forming at least three separate connection points that are all in a single plane.

2. The coupling structure as recited in claim 1, wherein the three planar cross-couplers are structured respectively as a cascade of 90 degree hybrid couplers.

3. The coupling structure as recited in claim 2, in which at least two cross-couplers of the three planar cross-couplers respectively have at one end of the respective cascade two adjacent input/output points, forming the input/output points of the coupling structure.

4. The coupling structure as recited in claim 1, wherein the three planar cross-couplers are arranged entirely in a same signal conductor layer.

5. The coupling structure as recited in claim 1, wherein the three planar cross-couplers are arranged in the form of a star.

6. The coupling structure as recited in claim 1, wherein the three planar cross-couplers are situated one after another, a middle one of the three planar cross-couplers being laterally off-set with respect to a first one and a third one of the three planar cross-couplers, and a signal transmission line, running next to the middle cross-coupler, connects an input/output point of the first cross-coupler with an input/output point of the third cross-coupler.

* * * * *